United States Patent [19]

Schuessler et al.

[11] 4,045,751

[45] Aug. 30, 1977

[54] ARC BARRIER FOR A RELAY SWITCH

[75] Inventors: John C. Schuessler; David J. Tapp, both of West Covina, Calif.

[73] Assignee: Leach Corporation, Los Angeles, Calif.

[21] Appl. No.: 669,212

[22] Filed: Mar. 22, 1976

[51] Int. Cl.[2] ..... H01H 9/30

[52] U.S. Cl. ..... 335/201; 200/144 R

[58] Field of Search ..... 335/201, 128, 132; 200/144, 302, 10; 337/110, 282

[56] References Cited

U.S. PATENT DOCUMENTS

| | | | |
|---|---|---|---|
| 3,295,078 | 12/1966 | Hrynewycz | 335/128 |
| 3,451,019 | 6/1969 | Auer et al. | 335/201 |
| 3,578,928 | 5/1971 | Schuessler et al. | 200/144 R |

*Primary Examiner*—Harold Broome

*Attorney, Agent, or Firm*—Christie, Parker & Hale

[57] ABSTRACT

An arc barrier for a multi-pole relay switch in which the barrier is molded in a single piece having compartments for receiving each of the switch poles. The ends of the housing are clamped between parallel frame members having inwardly directed portions which engage the ends of the housing when it is inserted between the frame members. The walls extending between the clamped ends of the housing are provided with one or more open slots which permit the housing to be deformed slightly by the compressive force of the retaining frame members.

6 Claims, 6 Drawing Figures

ARC BARRIER FOR A RELAY SWITCH

FIELD OF THE INVENTION

This invention relates to electrical relays, and more particularly, to barriers for shielding the electrical contacts against arcing. Miniature relays for use in the aircraft industry have been the subject of continuous refinement in an effort to reduce the size and weight of the relays without sacrifice in capacity or performance. Closer spacing of components relative to the switch contacts increases the risk of dielectric breakdown and arcing between adjacent pairs of contacts or between the contacts and surrounding conductive frame parts. It has been the practice to reduce or eliminate arcing by providing arc barriers of high dielectric material such as described in U.S. Pat. No. 3,578,928, assigned to the same assignee as the present invention. The problem has been in securing the dielectric firmly in place to provide effective shielding of the contacts. The above patent describes an arc barrier which is maintained securely in position by a spring arrangement which presses the molded barrier against the inside of the cover of the relay, holding the barrier securely in place.

SUMMARY OF THE INVENTION

The present invention is directed to an improved arc barrier and an arrangement for anchoring the barrier securely in position. The present invention provides a more compact design and eliminates the need for separate springs or other locking elements. This is accomplished, in brief, by providing in a multi-pole relay in which fixed and movable switch contacts are supported from a base member and fully enclosed in a cover secured to the base member, an arc barrier comprising a molded housing of high dielectric material having outer end walls and three connecting side walls forming a chamber open on one side. The barrier has one or more divider walls to separate the interior of the housing into a plurality of cubical spaces for receiving individual sets of contacts for each switch pole. The housing is positioned with one wall resting against the base member with the end walls clamped between parallel frame members having clamping surfaces projecting toward each other. A wall of the housing extending parallel to the base is provided with one or more open ended slots extending parallel to the end walls. The spacing between the clamping surfaces is slightly less than the normal width between the end walls of the housing. The slotted wall of the housing is put in compression by the clamping members, the slots permitting slight bending of the housing walls under the compressive force of the clamping members.

DESCRIPTION OF THE DRAWINGS

For a better understanding of the invention, reference should be made to the accompanying drawing, wherein.

DETAILED DESCRIPTION

Figure 1:
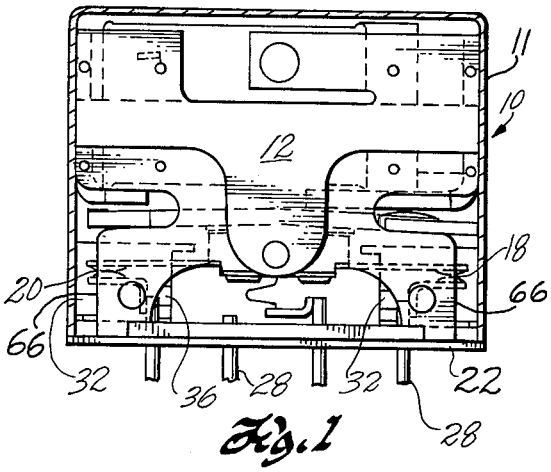
FIG. 1 is a side elevational view of the relay assembly partly in section.
Figure 2:
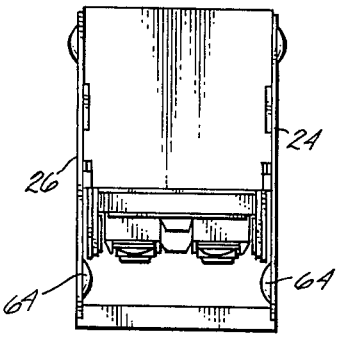
FIG. 2 is an end view of the relay assembly partly in section.
Figure 6:
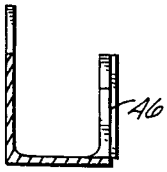
FIG. 6 is a sectional view taken substantially on the line 6—6 of FIG. 3.
Figure 3:
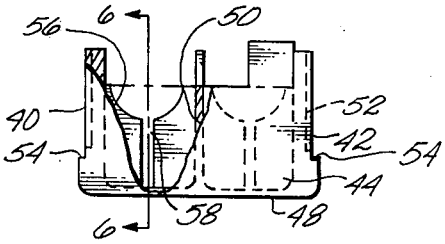
FIG. 3 is a top view of the arc barrier, partly in section.
Figure 4:
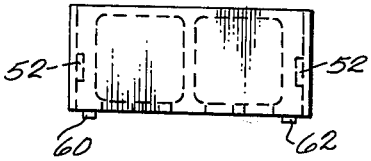
FIG. 4 is a side view of the arc barrier.
Figure 5:
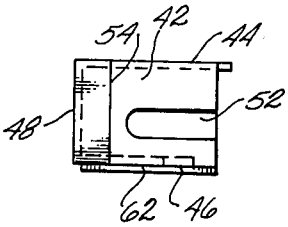
FIG. 5 is an end view of the arc barrier.

Referring to the drawings in detail, the numeral 10 indicates generally a relay of the type described in more detail in copending application, Ser. No. 669,217, filed Mar. 22, 1976, entitled "Improved Electromagnetic Actuator for a Relay", and assigned to the same assignee as the present invention. The relay includes an electromagnetic motor assembly 12 which actuates a pivotally mounted armature assembly 14. The armature assembly includes a group of contact blades 16 mounted at their center and being provided with moving electrical contacts 18 and 20 at the outer ends. Each blade provides a separate pole of the relay switch. The motor assembly 12 is mounted on a base member or header 22 by a pair of side frame plates 24 and 26. The fixed contacts are supported on the ends of contact pins 28 supported by glass insulator seals in the header. In the arrangement shown in FIGS. 1 and 2 a double-pole double-throw switch assembly is shown by way of example.

According to the present invention, a pair of arc barriers 32 and 36 are provided for the sets of contacts at either end of the contact blades 16. The arc barrier is shown in detail in FIGS. 3–6. The barrier is molded or otherwise formed as a single piece of high dielectric material such as a thermosetting plastic or molded ceramic. The arc barrier includes a pair of end walls 40 and 42, a top wall 44, bottom wall 46, and side wall 48. The remaining side of the housing forming the arc barrier is open for receiving the contacts when the barrier is moved into operative position. An arc barrier for a two-pole switch has an intermediate partition 50 which divides the housing into two compartments or cubicals. It will be understood that an arc barrier for three or four pole switches would be formed with three or four such compartments or cubicals by providing additional partitions.

The side wall 48 is flat and is adapted to fit snuggly against the interior surface of a cover 11 of the relay when assembled. The end walls are provided with shallow grooves 52 which extend parallel to the top and bottom walls. The end walls 40 and 42 are also formed with projecting portions 54 which form stops. The bottom wall 46 has the outer edge thereof formed with semi-circular openings 56 in each cubical. In addition a narrow open slot 58 extends from the center of the semicircular opening 56 to the inside surface of the side wall 48. In addition, the bottom wall 46 is provided with a pair of supports 60 and 62 which project slightly below the surface of the bottom wall.

Referring again to FIGS. 1 and 2, the side frame plates 24 and 26 are provided with inwardly projecting dimples 64 which operate to retain the arc barriers in position. After the relay is assembled but before the cover 11 is attached, the arc barrier is assembled in position by inserting each of the barriers between the frame plates 24 and 26 with the dimples 64 engaging the grooves 52 in the end walls 40 and 42 of the arc barrier housing. The bottom supports 60 and 62 are in engagement with the surface of the header 22. The arc barrier housing is thrust inwardly between the plates 24 and 26 until the stops 54 engage the vertical edges 66 of the side frame plates. The distance between the outer surfaces of the end walls 40 and 42 is such that the end walls must be squeezed together slightly for the dimples to engage the grooves 52. The slots 58 permit the end and side walls to be deformed inwardly in this manner. The dimples 64 provide a clamping action on the end of the arc barrier housing which stresses the housing. The housing is distorted sufficiently that even with the shrinkage experienced in molded plastic materials with aging under temperature cycling, for example, the housing is still held in a vise-like grip between the dimple 64, the internal stressing of the housing causing the end walls to be urged outwardly against the projection 64.

With the arc barrier inserted in place, the cover 11 is fitted over the relay and hermetically sealed to the base or header 22, thereby locking the arc barriers in position. It should be noted that the clamping action of the dimples 64 pressing against the end walls of the arc barrier housing causes the end walls to depart slightly from their normal parallel relationship, so that the end walls tend to converge. The effect of this is to produce a component of force tending to wedge the barriers outwardly against the inside of the cover 11. Thus not only do the dimples 64 clamp the barrier housing against any tendency to move laterally, but also tend to wedge the barrier against the cover and keep it from moving in a direction parallel to the side frame plates 24 and 26.

What is claimed is:

1. Apparatus for preventing arcing between the contacts and other conductive parts of a relay, comprising a molded housing of non-conductive material forming at least one substantially cubical space open on one end for receiving the relay contacts, one wall of the housing having an open slot extending from an edge at the open end, and a pair of spaced parallel retaining members having opposing clamping surfaces projecting toward each other, the housing being positioned between and in engagement with said surfaces, with the slotted wall extending laterally between the retaining members, the spacing between the clamping surfaces being slightly less than the width of the housing whereby the slotted wall of the housing is put in compression by the clamping members.

2. The apparatus of claim 2 wherein the clamping members include a pair of flat frame plates, each of the plates having a portion projecting toward the other plate, said portions forming the clamping surfaces.

3. Apparatus of claim 2 wherein the surfaces of the walls of the housing engaged by said clamping surfaces have grooves extending parallel to the surface of the slotted wall, the retaining members having projecting portions slidably engaging said grooves when the housing is moved into assembled position.

4. A relay comprising a header, a plurality of contact pins extending through the header, fixed electrical contacts supported on said pins, a relay motor assembly, a pair of spaced parallel frame plates supporting the motor assembly on the header, the motor assembly including a pivotally supported contact blade and movable contacts at the ends of the blade movable into and out of contact with said fixed contacts, and an electrical arc barrier including a housing of dielectric material having a pair of parallel end walls joined by a bottom wall, a side wall, and a top wall, the bottom wall extending parallel to and supported by the header between said frame plates, the fixed and moving contacts extending into the space between the top and bottom walls, the bottom wall having an open-ended slot extending toward the side wall from the margin of the bottom wall intermediate the end walls, the end walls being clamped between the side frame plates with sufficient force to force the end walls inwardly and partly closing up the slot.

5. The relay of claim 4 further including an outer cover forming a closed chamber with the header enclosing the relay motor assembly contacts and arc barrier.

6. The relay of claim 5 wherein the side frame plates have projecting portions on the inside surfaces thereof engaging the end walls of the arc barrier, the end walls converging slightly in a direction away from the side wall, the projecting portions providing a wedging action on the converging end walls urging the side wall outwardly against the inside of the cover.

* * * * *